US006748732B2

(12) United States Patent
Limmer

(10) Patent No.: US 6,748,732 B2
(45) Date of Patent: Jun. 15, 2004

(54) CLEANING DEVICE FOR A ROTOR SPINNING UNIT

(75) Inventor: Ralf Limmer, Bettbrunn (DE)

(73) Assignee: Rieter Ingolstadt Spinnereimaschinenbau AG, Ingolstadt (DE)

( * ) Notice: Subject to any disclaimer, the term of this patent is extended or adjusted under 35 U.S.C. 154(b) by 0 days.

(21) Appl. No.: 10/337,928

(22) Filed: Jan. 7, 2003

(65) Prior Publication Data

US 2003/0177750 A1 Sep. 25, 2003

(30) Foreign Application Priority Data

Jan. 9, 2002 (DE) ..... 102 00 431
Feb. 12, 2002 (DE) ..... 102 05 666

(51) Int. Cl.[7] ..... D01H 7/885
(52) U.S. Cl. ..... 57/302; 57/263
(58) Field of Search ..... 57/263, 264, 400, 57/300, 302, 301

(56) References Cited

U.S. PATENT DOCUMENTS 3,869,851 A * 3/1975 Muller ..... 57/302
4,028,136 A 6/1977 Kamp
4,125,991 A 11/1978 Stahlecker
4,135,354 A 1/1979 Stahlecker
4,155,217 A * 5/1979 Stahlecker ..... 57/302
4,480,433 A * 11/1984 Ryer, II ..... 57/302
4,542,620 A 9/1985 Kase et al.
4,548,030 A * 10/1985 Lauschke et al. ..... 57/302
5,694,756 A * 12/1997 Lindner ..... 57/263

FOREIGN PATENT DOCUMENTS

DE 2457034 A1 * 6/1976 ..... 57/300

OTHER PUBLICATIONS

German Patent Office Search Report, May 22, 2002.

* cited by examiner

*Primary Examiner*—Danny Worrell
(74) *Attorney, Agent, or Firm*—Dority & Manning

(57) ABSTRACT

The present invention relates to a cleaning device of a rotor spinning unit with at least one cleaning head and an extensible device to extend and retract the cleaning head. The cleaning head is replaceable and connected to the extensible device.

19 Claims, 4 Drawing Sheets

CLEANING DEVICE FOR A ROTOR SPINNING UNIT

BACKGROUND

The present invention relates to a cleaning device for a rotor spinning unit with a cleaning head and an extensible device for the extension and retraction of at least the cleaning head.

In a known rotor spinning machine a traveling service unit contains a cleaning device for the cleaning of a spinning rotor (DE 24 57 034 A1). The cleaning device has a telescope-like extensible compressed-air pipe whose forward end can be retracted in part once the service unit has positioned itself in front of the spinning rotor. At the forward end of the compressed-air pipe a nozzle to blow out the compressed air and a cleaning brush are provided for the cleaning of the inside of the rotor plate. During the cleaning process, compressed air is blown out of the nozzle and the telescopic pipe is rotated by a motorized drive so that the cleaning brush rotates inside the rotor plate.

SUMMARY

It is an object of the present invention to provide a cleaning device for a rotor spinning unit that would make it possible to achieve a constantly high cleaning effect and adaptation to a modified rotor spinning unit while simplifying maintenance of the cleaning device. Additional objects and advantages of the invention will be set forth in part in the following description, or may be obvious from the description, or may be learned through practice of the invention.

According to an embodiment of the invention, a cleaning device with a cleaning head and an extensible device for extension and retraction of at least the cleaning head is provided for a rotor spinning unit. The extensible device can be designed as an extensible telescoping device, a swiveling device, a combination of swiveling and telescoping device or similar device. The cleaning head is positioned by means of the extensible device e.g. in the rotor plate of a spinning rotor or directly adjoining a yarn draw-off nozzle. The cleaning device is preferably placed in a service unit traveling e.g. along a plurality of spinning stations of a rotor spinning machine. By displacing and aligning the service unit, it is positioned across from the rotor spinning unit in such manner that the cleaning head can be positioned by the extensible device in or at the element of the rotor spinning unit to be cleaned. The cleaning head may be equipped with at least one compressed-air nozzle, at least one scraper, at least one cleaning bristle or a combination of these elements. Due to the fact that the cleaning head is replaceable and connected to the extensible device, it can simply be replaced when worn or dirty. This is necessary, for example, when a scraper, a bristle or a nozzle of the cleaning head is soiled or clogged up. Or else a replacement can be made when e.g. an element of the rotor spinning unit is replaced in order to provide a cleaning head that is adapted to the inside and/or outside form of the replaced element. Optimal cleaning of the replaced element of the rotor spinning unit can then be achieved with the adapted cleaning head. An example of a replaceable element is a spinning rotor that has a different rotor pot geometry after the replacement.

If the cleaning head is used to clean a spinning rotor, preferably at least one first cleaning element is assigned to the rotor channel and at least one second cleaning element to the rotor side. By assigning the cleaning elements, these can be adapted especially to the shape of the rotor pot in order to clean the channel and e.g. the sidewalls or the bottom of the rotor pot by means of specially designed cleaning elements. While mostly fibers must be removed from the rotor channel after a yarn breakage for example, rather resistant dirt must be removed from the pot bottom or from the sloped sidewall. In one embodiment for example, it is advantageous to clean the rotor channel by means of one or several bristles, while the sidewalls are scraped by means of a scraper.

In a variant of the invention, a first and a second cleaning head are installed on the extensible device, whereby the first one is provided for the cleaning of a spinning rotor and the second one for the cleaning of a yarn draw-off nozzle. They are preferably at such distance from each other or can be positioned by the extensible device at such distance from each other that in their end positions the first cleaning head is positioned in the spinning rotor while the second cleaning head is positioned at the yarn draw-off nozzle. Each cleaning head can be driven by its own drive unit or by a common drive unit.

In a first embodiment, the cleaning head, of which at least one is provided, is held in a seat installed on the extensible device. In another embodiment, the cleaning head, of which at least one is provided, is mounted on a drive unit to rotate the cleaning head and is replaceable. If several cleaning heads are used, a holder can be provided on fixed seats and/or drive units. In case of a fixed seat, the element to be cleaned, e.g. the spinning rotor, can be put in motion by a separate drive that may be mounted e.g. on the extensible device or by a drive already used for the element to be cleaned.

If the cleaning head is attached by means of a catch or snap-in connection that can be opened, or by means of a bayonet connection to the seat or to the driving unit, the cleaning head can be replaced quickly, e.g. without any tool.

In an advantageous embodiment of the cleaning head for the cleaning of a yarn draw-off nozzle, the rotational axis of the cleaning head is not aligned coaxially with the symmetry axis of the yarn draw-off nozzle. The cleaning head rotating at an angle seizes deposits on the yarn draw-off nozzle and transports them to its edge. As soon as the impurities have been transported over the edge of the yarn draw-off nozzle, they are thrown off at that location by the cleaning head. Thereby the dirt adhering to the cleaning elements is prevented from being transported in a circular motion to the yarn draw-off nozzle without finally being removed from it.

In another embodiment of the cleaning head, the latter is supplied with compressed air and the compressed air is blown from the nozzle in the direction of the element to be cleaned. The bristles and/or scraper of the cleaning head are advantageously placed at a distance from the nozzle. As a result, the nozzle can blow directly on the element of the rotor spinning unit to be cleaned. In addition, the dirt loosened by the compressed air from the element to be cleaned is carried away from the soiled area. Here, the bristles and/or scraper advantageously provide a free passage for the compressed air at the outer circumference of the cleaning head so that the loosened impurities are blown away from the cleaning head and the element to be cleaned between the bristles and/or the scrapers.

In another embodiment, the seat and/or the drive unit are provided with a compressed-air supplying device with a locking device for the cleaning head. When the cleaning head is used, an actuator of the cleaning head actuates the locking device of the seat or the drive unit so that the locking device opens the compressed-air passage to the cleaning head. Here, the compressed-air passage to the cleaning head is closed by the locking device when the cleaning head is removed from the seat or the drive unit or when the inserted cleaning head does not have an actuator, e.g. when the cleaning head does not need compressed air.

In an advantageous embodiment, the extensible unit of the cleaning device is a combination of a linear-movement device executing a linear back and forth movement in one direction, and of an extensible arm that is moved by a telescoping guide and is capable of pivoting. The extensible unit can then execute a linear movement simultaneously with a swiveling movement. In this way, a complex and precise movement of the extensible arm becomes possible with little mechanical expenditure. If the cleaning device is installed e.g. on a service unit, a cleaning head for the cleaning of the spinning rotor or the extensible unit in rest position need not be positioned directly in a position across from the rotor. Only for cleaning is the cleaning head extended from a border zone of the service unit towards the spinning rotor. Thereby it is possible to place e.g. a piecing unit for the piecing of the yarn on the service device directly across from the rotor without crowding the cleaning device in such a configuration.

In another embodiment, the cleaning head has at least one cleaning element that comes into contact with the element to be cleaned at least intermittently during the rotation and thereby cleans it. At least one compressed-air nozzle is installed on the rotating cleaning head to blow air into the contact zone between the cleaning element and the element to be cleaned, at least when contact is made between at least one cleaning element and the element to be cleaned. In that case, the compressed air reaches the contact zone situated in the sense of movement of the cleaning element. Thereby, a removal of the dirt deposit by blowing in the area most affected by dirt deposits within range of one or several cleaning elements is ensured.

In an advantageous embodiment, the cleaning element or cleaning elements are not evenly distributed around the outer circumference of the cleaning head, but the cleaning elements are arranged with distances or gaps between them on the outer circumference so that the compressed-air nozzle can blow into the gaps. In another embodiment, at least one compressed-air nozzle can be positioned in such a manner relative to the rotating cleaning head so that the stream of compressed air coming from the compressed-air nozzle is directed into the path of the (at least one) cleaning element.

If the cleaning head is mounted so as to be capable of movement relative to the compressed-air nozzle, or if the compressed-air nozzle is mounted so as to be capable of movement relative to the cleaning head, a movement of the two elements relative to each other makes it possible to blow over different areas of the cleaning head. In an especially advantageous embodiment, the compressed-air nozzle is used to clean the cleaning head as well as the element to be cleaned. In that case, the compressed air is blown on the element to be cleaned when the nozzle or the cleaning head is in a first position, so that it is freed of deposited dirt. In a second position of the compressed-air nozzle or of the cleaning head, the stream of compressed air is directed on the cleaning head, so that the latter is blow-cleaned preferably while it rotates.

For the cleaning of a yarn draw-off nozzle, the compressed-air nozzle is aligned preferably coaxially with the yarn draw-off nozzle, so that the stream of compressed air that is blown through the yarn draw-off nozzle continues into the yarn draw-off direction that follows.

An example of an embodiment of the invention is explained through figures.

DETAILED DESCRIPTION

Figure 1:
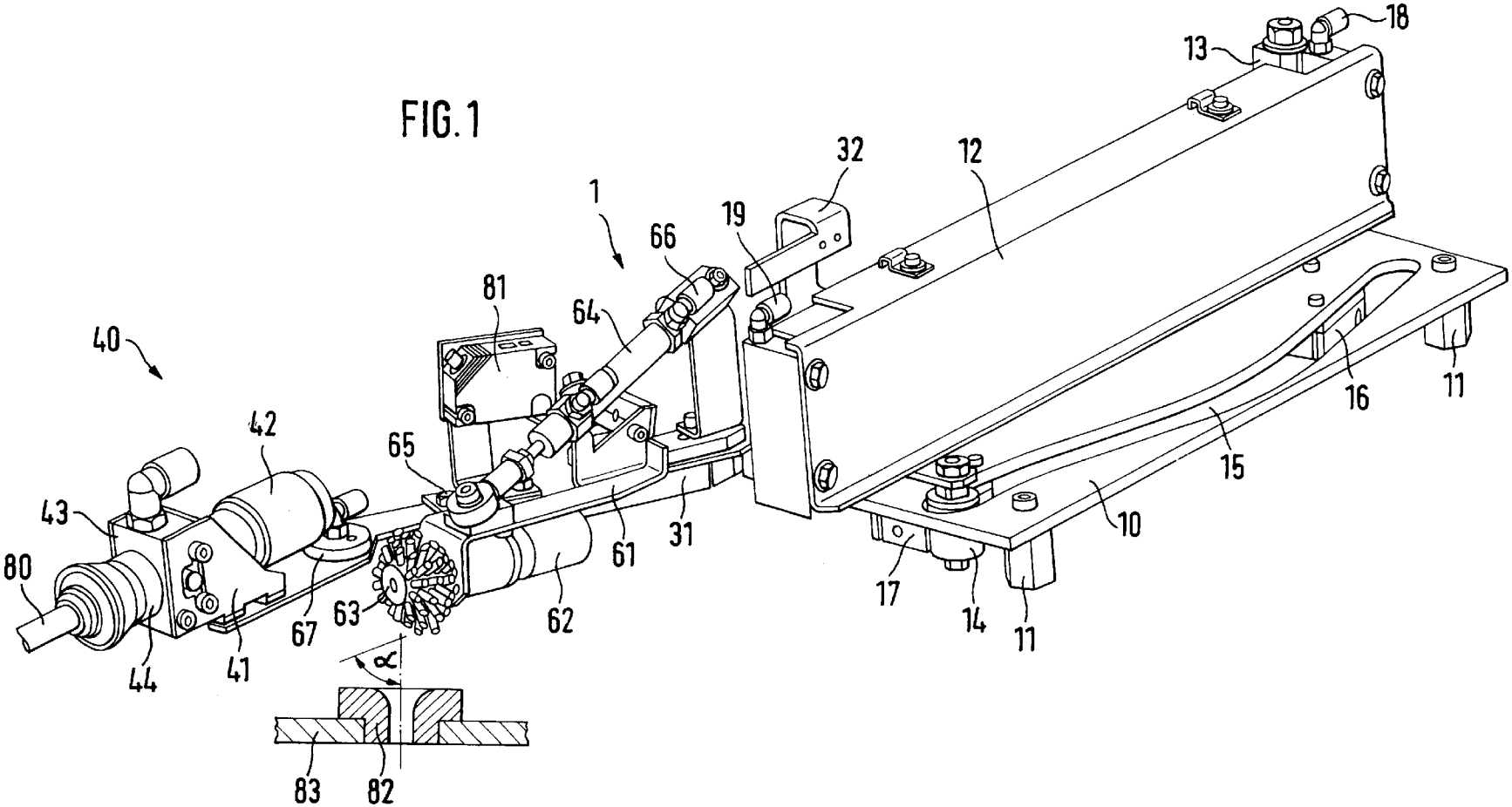
FIG. 1 shows a lateral perspective view of a cleaning module of a piecing robot, as seen from the right side.

Reference will now be made in detail to embodiments of the invention, one or more examples of which are shown in the drawings. The embodiments are provided by way of explanation of the invention, and not as a limitation of the invention. For example, features illustrated or described as part of one embodiment may be used with another embodiment to yield still a further embodiment. It is intended that the invention include these and other modifications and variations.

Figure 2:
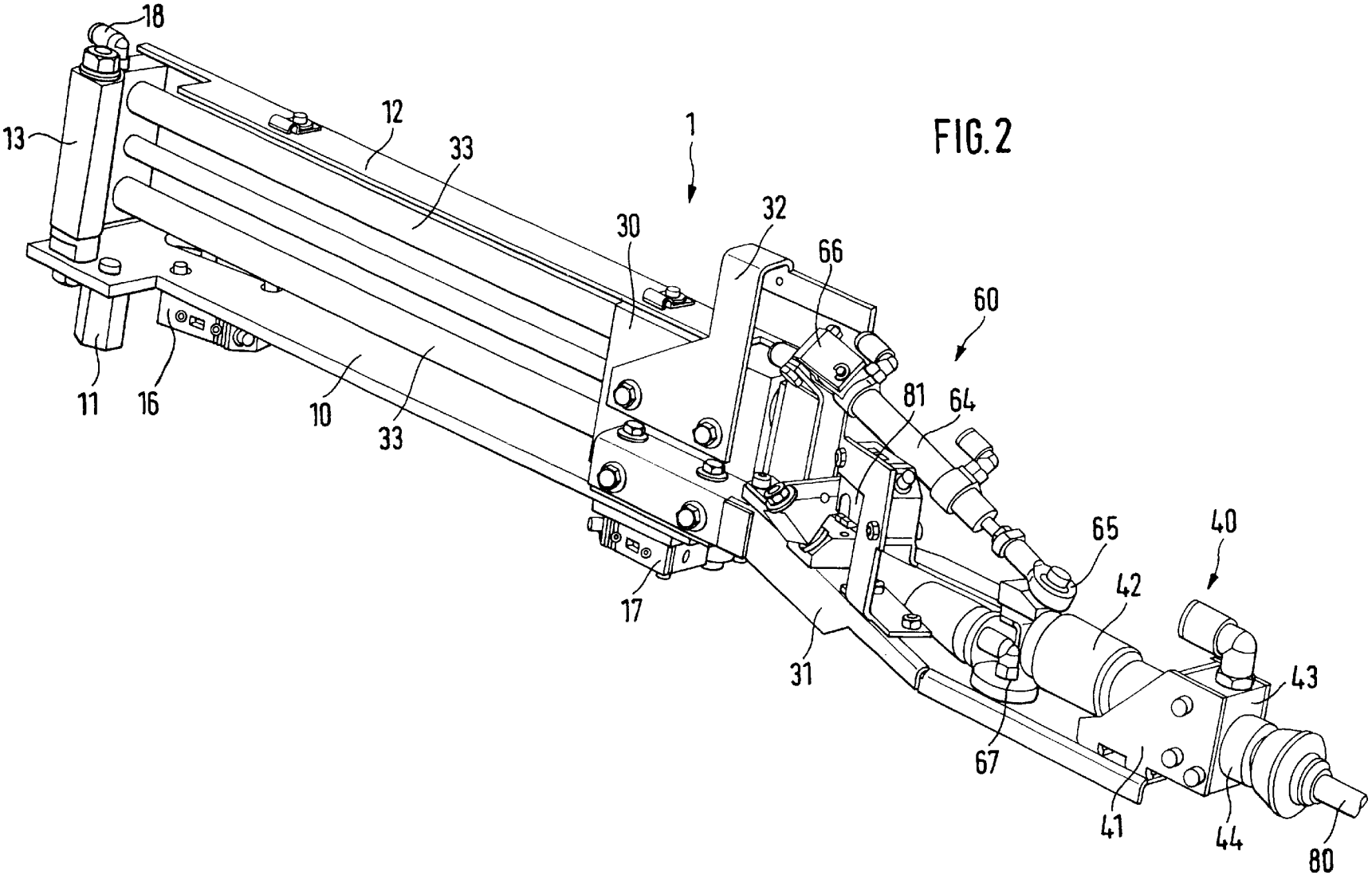
FIG. 2 shows a lateral perspective view of a cleaning module of a piecing robot, as seen from the left side.

FIGS. 1 and 2 show perspective lateral views of a cleaning module 1 installed in a piecing robot (not shown) of a rotor spinning machine. The cleaning module I is attached to the piecing robot by means of supports 11. The supports 11 bear a bearing plate 10 on which a magneto-pneumatic linear drive 12 is installed. A longitudinally displaceable travel plate 30 is mounted on guide rails 33. Magnets that can be displaced by means of compressed air and move the travel plate 30 via magnetic coupling as they are shifted are mounted within the guide rails 33. The compressed air for the displacement of the magnets within the guide rails 33 is supplied through the compressed-air connections 18, 19. One end of the linear drive 12 is mounted by means of a swivel pin 13 on the bearing plate 10 so as to be capable of swiveling. As the travel plate 30 is extended and retracted, the linear drive 12 is swiveled by means of a sliding guide. In the shown embodiment the bearing plate 10 ends in a guiding groove 15 into which a guide pin 14 assigned to the travel plate 30 enters. As the travel plate 30 is displaced, the guide pin 14 is displaced along the guiding groove 15, so that the linear drive 12 executes a swiveling movement imposed by the guiding groove 15. At the end points of the travel way of the travel plate 30 within the linear drive 12, the end position is detected by means of limit switches 16, 17.

FIGS. 1 and 2 show the linear drive 12 with the travel plate 30 fully extended. In the retracted state the travel plate 30 is pulled back to the rear stopping point that is detected by the limit switch 16.

A holding hoop 32 and a boom 31 are attached to the travel plate 30. The holding hoop 32 serves to hold and guide electrical and compressed-air lines to the cleaning units. A first cleaning unit 40 for the cleaning of a spinning rotor 80 and a second cleaning unit 60 for the cleaning of a yarn draw-off nozzle 82 while the rotor cover 83 is open are located on the boom 31. The first cleaning unit 40 is mounted on a holder 41 at the forward end of the boom 31. The holder 41 supports an electric motor 42 and a compressed-air supply 43 to convey compressed air to a cleaning head 45 (FIG. 3B). The cleaning head 45 is replaceable and is inserted in an adapter seat 44 that is in turn connected to the motor shaft of the electric motor 42 (see FIG. 3B).

The second cleaning unit 60 is located on the boom 31, behind the first cleaning unit 40. An electric motor 62 to drive a brush head 63 is mounted on a swiveling boom 61. The swiveling boom 61 is mounted on a two-axle swivel bearing 66 on the boom 31. The piston of a pneumatic lifting cylinder 64 is connected via a ball head articulation 66 and a mounting element to the boom 31. The piston rod is connected by its forward end on a second two-axle swivel bearing 65 to the forward end of the swiveling boom 61. The piston of the lifting cylinder 64 is supplied with compressed air through compressed-air connections and is extended or retracted. Extending the piston rod causes the swiveling boom 61 to be swiveled downward so that the brush head 63 comes to lie on the yarn draw-off nozzle in order to clean the latter through the rotational movement of the brush head 63.

FIG. 1 schematically shows the yarn draw-off nozzle 82 that is mounted in a hinged rotor cover 83 of a spin box of the rotor spinning machine. As drawn, the position of the symmetrical axis of the yarn draw-off nozzle, indicated by a dotted line, in relation to the rotational axis, indicated by a dotted line, of the brush head 63 causes the bristles of the brush head 63 to come into contact only momentarily with the yarn draw-off nozzle.

During a complete revolution the bristles are intermittently not in contact with the surface of the yarn draw-off nozzle. As a result the dirt is picked up from the surface of the yarn draw-off nozzle and is thrown off from the bristles by centrifugal force during the passage through the contact-free zone. In addition, a blow nozzle 67 is installed on the boom 31 and is directed on the yarn draw-off nozzle 82 when the boom 31 and the travel plate 30 are extended. Before the second cleaning unit 60 swivels down, it can thus clean off the larger dirt particles from the yarn draw-off nozzle by blowing compressed air on it. In addition, following the downward swiveling of the second cleaning unit 60, the brush head 63 can be blown clean by the compressed air coming from the blow nozzle 67. When cleaning with the brush head 63 is completed and the second cleaning unit 60 has swiveled up, loose dust deposits can again be cleaned by means of compressed air from the yarn draw-off nozzle 82.

Figure 3A:
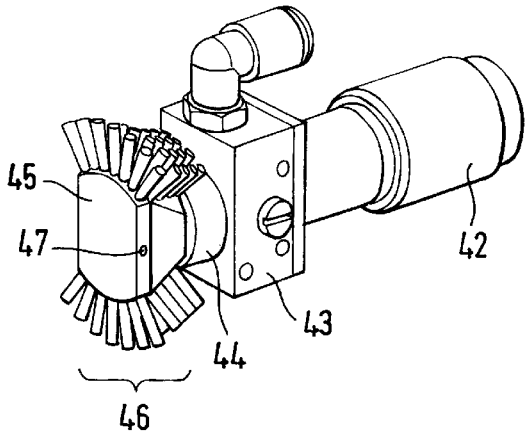
FIG. 3A shows a perspective view of the rotor cleaning unit.
Figure 3B:
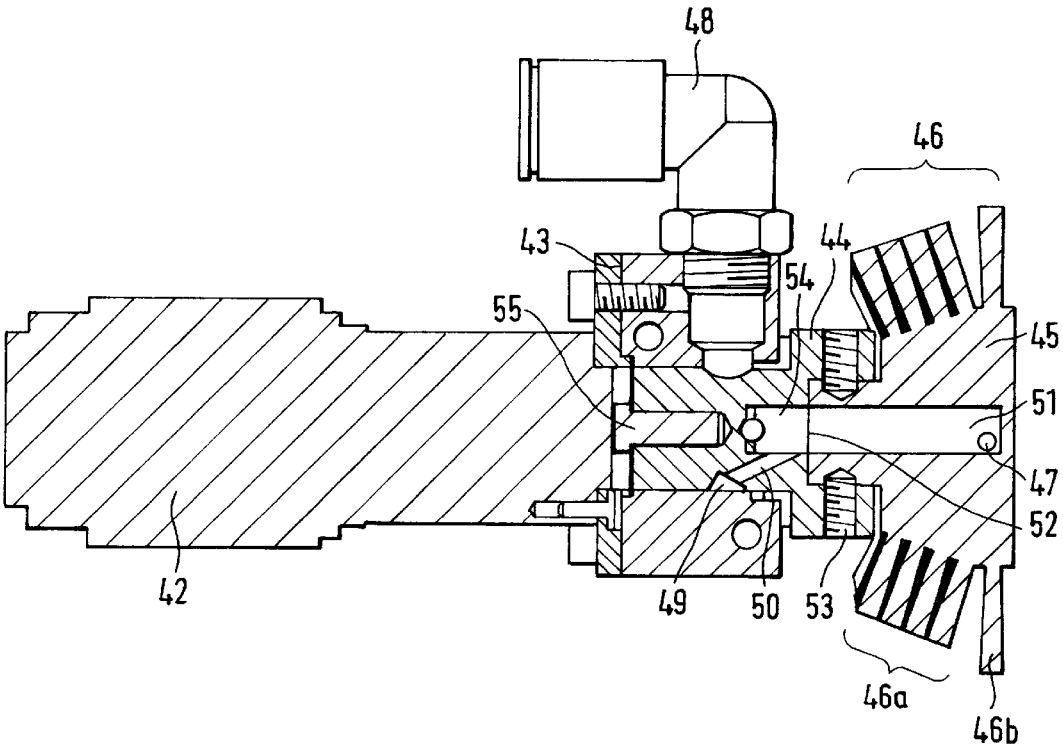
FIG. 3B shows a cross-section of the rotor cleaning unit of FIG. 3A.

FIG. 3A shows a perspective view of the first cleaning unit 40, shown again in detail in cross-section in FIG. 3B. Bristles 46 adapted to the inside shape of the rotor pot of the rotor 80 are installed on the cleaning head 45. The bristles 46*b* are long and narrow in axial direction, so that they enter the groove of the spinning rotor during the rotation of the cleaning head 45. The bristles 46*a* are shorter and further extended in axial direction than the bristles 46*b*, so that they clean the sidewall of the spinning rotor. A nozzle 47 on the side of the cleaning head 45 directs a stream of compressed air on the rotor channel and blows dirt loosened by the bristles 46*b* out of the rotor pot. For this, the bristles 46 are placed at a distance from each other in the circumferential direction, so that the compressed air blown in through the nozzle 47 is diverted between the bristles 46 in axial direction to the rear (to the left in the cut-away drawing of FIG. 3B), so that the dirt is removed from the rotor pot. Compressed air is conveyed via an axial bore 51 in the cleaning head 45 to the nozzle 47. The bore 51 is connected via a passage 52 to an axial bore 54 in the adapter seat 44. Compressed air is in turn supplied to the bore 54 through several channels 50 distributed over the circumference, extending in radial direction and connected to a groove 49 formed in circumferential direction on the adapter seat 44. The adapter seat 44 is attached to the motor axle 55 and is mounted rotatably within the compressed-air supply 43. The rotational bearing between the adapter seat 44 and the compressed air supply 43 at the same time seals off the groove 49 against loss of compressed air to the outside. Compressed air is conveyed through a bore in the compressed-air supply 43 and through a compressedair connection 48 to the groove 49.

As FIG. 3B shows, the cleaning head 45 and the adapter seat 44 are connected to each other by means of stud screws inserted into a threaded bore 53. A connection between the cleaning head 45 and the adapter seat 44 is advantageously established by means of a snap-in connection, a catch connection or a bayonet connection. For example, instead of the threaded bores 53, blind holes are provided into which spring-loaded pointed pegs are introduced and are pressed inward in radial direction by the adapter seat 44. When the cleaning head 45 has been inserted into the adapter seat 44, the pegs catch in depressions on the outer circumference of the peg of the cleaning head inserted into the adapter seat 44. Thereby secure locking of the cleaning head 45 in the adapter seat 44 and also rapid replacement without tools is made possible.

Instead of the free passage 52, a compressed-air connection between the bores 51 and 54 can also be provided, whereby the bore 54 is closed off in the adapter seat 44 when the cleaning head 45 is removed. The adapter seat 44 can be supported e.g. on a spring-loaded ball that is pressed against a hemispherical cup as the adapter seat opens as soon as the cleaning head is removed. When a cleaning head 45 is inserted into the adapter seat 44 with an actuating device for the compressed-air connection (e.g. protruding pegs that press the ball back), the compressed-air passage between adapter seat 44 and cleaning head 45 is opened. In this case it is also possible to use a cleaning head having no actuating device, so that no compressed air emerges from the adapter seat 44.

Thanks to the interchangeability of the cleaning head 45, the latter can thus be replaced rapidly when it is worn or can be exchanged against a clean cleaning head. Even when spinning rotors with different dimensions are used, a special cleaning head, designed for the spinning rotor can be used and can then obtain optimal cleaning results. The brush head 63 of the second cleaning unit 60 is also advantageously replaceable and connected to the electric motor 62, so that the brush head can also be exchanged rapidly. Instead of a brush head 63, it is also possible to provide a cleaning head which, additionally or alternatively is equipped with scrapers or additionally or alternatively with compressed-air nozzles blowing compressed air on the yarn draw-off nozzle 82 as it rotates. The connection between the cleaning head and the second cleaning unit 60 can also be in form of a catch, a snap-in connection, a bayonet connection or similar device.

Instead of the electric motors 42 and/or 62, a pneumatic drive can be provided for the cleaning head. In that case, the air released by the pneumatic drive is advantageously directed in such manner that it blow-cleans the other elements of the spinning rotor unit (housing, rotor cover, opener roller, fiber channel etc.) Alternatively, the exhaust air of the pneumatic drive is conveyed e.g. in hoses into an area from which no dust is raised, e.g. in or at the service unit.

Figure 4:
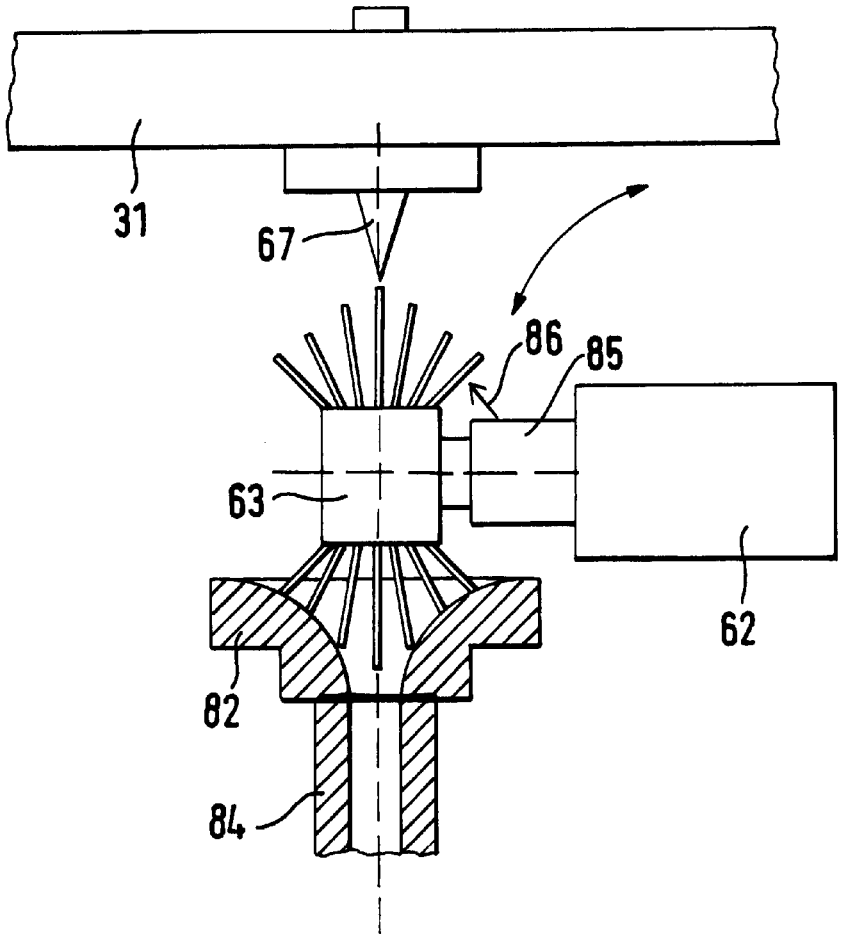
FIG. 4 shows a schematic representation of the arrangement of a cleaning unit for a yarn draw-off nozzle and FIG. 5 shows a schematic front view of a rotor cleaning head.

FIG. 4 shows once more the relative positioning of the blow nozzle 67 located on the boom 31 above the yarn draw-off nozzle 82, as has already been shown schematically in FIG. 1. When the boom 31 is in position, the blow nozzle 67 is aligned coaxially with the yarn draw-off nozzle 82. The air stream directed from the blow nozzle 67 therefore blows centrally on the yarn draw-off nozzle to remove the dirt attached to it. Part of the compressed-air stream enters through a central opening in the yarn draw-off nozzle into an adjoining small yarn draw-off tube 84. The small yarn draw-off tube 84 follows the yarn draw-off nozzle 82 and continues the yarn draw-off channel, whereby only part of the small yarn draw-off tube is shown here. The air stream blows out impurities in the small yarn draw-off tube 84 such as fibers etc. towards its outlet.

The cleaning operation of a spinning station by the cleaning module 1 can here take the following course: Following a yarn breakage the piecing robot with the cleaning module 1 travels to the spinning station. The piecing robot opens the cover of the spin box, whereby the rotor cover 83 is swiveled by 90° in the example shown in FIGS. 1 or 4, so that the yarn draw-off nozzle 82 is taken from its vertical into a horizontal position. When the rotor cover 83 has been opened, the cleaning module 1 is extended by means of the magneto-pneumatic linear drive 12 and the cleaning head 45 of the first cleaning unit 40 is positioned in the rotor plate of the spinning rotor. At the same time, this positioning aligns the blow nozzle 67 coaxially with the yarn draw-off nozzle 82. The yarn draw-off nozzle 82 and the small yarn draw-off tube 84 are blow-cleaned by a continuous or intermittently interrupted compressed-air stream coming from the blow nozzle 67. The cylinder 64 then extends the swiveling boom 61 so that the brush head 63 comes into contact with the inside wall of the yarn draw-off nozzle 82. The brush head 63 takes up the dirt deposits from the surface of the yarn draw-off nozzle 82 as a result of its rotation and conveys it to the side where it is thrown off by centrifugal force. At the same time, either intermittently during the rotation of the brush head, continuously during the rotation of the brush head, or at intervals during the rotation of the brush head 63, compressed air is blown from the blow nozzle 67 on the bristles of the brush head 63, so that even entwined fibers or sticky impurities are blown off the bristles. Following this cleaning process, the brush head 63 is swiveled back by means of the lifting cylinder 64, and another stream of compressed air can additionally be directed by the blow nozzle 67 on the yarn draw-off nozzle 82 to blow away possibly loosened impurities. In that case, especially the impurities loosened from the brush head 63 and deposited in the small yarn draw-off tube 84 are blown out of the latter.

FIG. 4 shows an embodiment of a compressed-air supply 85 located between the brush head 63 and the electric motor 62 that is e.g. identical with the compressed-air supply 63 of the first cleaning unit 40 as shown in cross-section in FIG. 3B. Thereby the compressed air, for example, can be conveyed to nozzles at the inner circumference of the brush body of the brush head 63, so that compressed air is blown from the brush body to the outside along the bristles. Or else, a nozzle is installed directly at the compressed-air supply 85 and blows a stream of compressed air 86 as shown in FIG. 4 on the bristles, thus cleaning them.

Figure 5:
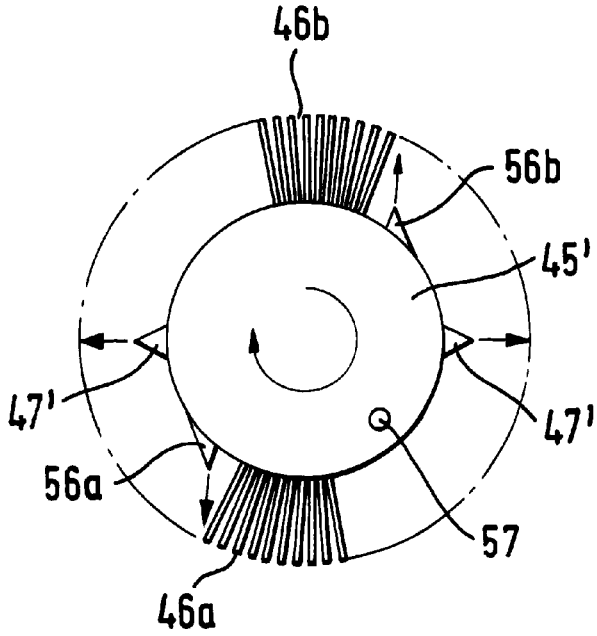

FIG. 5 shows another embodiment of a cleaning head 45' for the cleaning of the spinning rotor instead of the cleaning head 45. As shown in the frontal view, two nozzles 47' are installed on the outer circumference, whereby one nozzle 47' is directed on the rotor channel and the other nozzle 47' on the inclined inside wall of the rotor plate. The bristles **46*b* for the rotor channel which are standing together in a group are assigned a nozzle 56*b* and the bristles 46*a* for the cleaning of the rotor sidewall which are standing together in a group are assigned a nozzle 56*a*. As shown in FIG. 5, the direction of rotation of the cleaning head 45' is clockwise and the nozzles 56*a*, 56*b* are placed in clockwise direction before the corresponding groups of bristles 46*a*, 476*b*. The directed stream of compressed air is aimed at the contact surface between the bristles and the inner surface of the rotor plate. This contact area is represented for the rotor plate by the dotted circle. Thereby impurities pushed by the bristles in clockwise direction before them are blown away from them so that the impurities are effectively removed and not merely redistributed. The great distance between the groups of bristles (in FIG. 3*a* an upper group and a lower group is shown) allows for sufficiently wide gaps between the bristles so that the compressed air and the impurities it contains can be blown out between the bristles and the inside rotor wall to the outside of the rotor plate. Additionally, another nozzle 57 is located at the front of the cleaning head 45' and is directed on the bottom of the rotor plate where it blows away resistant impurities. In further embodiments of the cleaning heads 45, 45' the nozzles 47, 47', 56*a* and 57 can be combined with each other in any desired manner. If the cleaning head is rotated in reverse, nozzles identical to the nozzles 56*a*, 56*b* can also be installed on the other sides of the groups of bristles 46*a*, 46*b***.

It should be appreciated by those skilled in the art that modifications and variations can be made to the embodiments of the invention described herein without departing from the scope and spirit of the invention as set forth in the appended claims and their equivalents.

What is claimed is:

1. A cleaning device for a rotor spinning textile machine, said device comprising:

an extensible element movable from a retracted position to an extended position towards a spinning unit of the rotor spinning machine;

at least one cleaning head configured on said extensible element so as to be adjacent the spinning unit at said extended position of said extensible element; and said cleaning head being rotationally driven and configured for cleaning at least one of a spinning rotor or a yarn draw-off nozzle of the spinning unit, said cleaning head removably attached to said extensible element by way of engaging elements configured on said cleaning head and said extensible element so as to be replaceable with different cleaning heads by pulling said cleaning head off of said extensible element without the necessity of tools.

2. The cleaning device as in claim 1, wherein said cleaning head is a rotor cleaning head configured for cleaning a spinning rotor of the spinning unit and comprises first cleaning elements disposed thereon at a location for cleaning a rotor channel of the spinning rotor, and second cleaning elements disposed thereon at a location for cleaning a rotor wall of the spinning rotor.

3. The cleaning device as in claim 2, wherein said rotor cleaning head further comprises a third cleaning element disposed thereon at a location for cleaning a rotor bottom of the spinning rotor.

4. A cleaning device for a rotor spinning textile machine, said device comprising:

an extensible element movable from a retracted position to an extended position towards a spinning unit of the rotor spinning machine;

at least one cleaning head configured on said extensible element so as to be adjacent the spinning unit at said extended position of said extensible element; and said cleaning head being rotationally driven and configured for cleaning at least one of a spinning rotor or a yarn draw-off nozzle of the spinning unit, said cleaning head removably attached to said extensible element so as to be replaceable with different cleaning heads; and wherein said cleaning head is a yarn draw-off nozzle cleaning head configured for cleaning a yarn draw-off nozzle of the spinning unit and comprises cleaning elements disposed thereon with a rotational axis disposed at a non-parallel angle relative to a symmetrical axis of the yarn draw-off nozzle during a cleaning operation.

5. The cleaning device as in claim 4, wherein said non-parallel angle is between about 45 degrees to about 90 degrees with respect to the symmetrical axis of the yarn draw-off nozzle.

6. A cleaning device for a rotor spinning textile machine, said device comprising:

an extensible element movable from a retracted position to an extended position towards a spinning unit of the rotor spinning machine;

at least one cleaning head configured on said extensible element so as to be adjacent the spinning unit at said extended position of said extensible element; and said cleaning head being rotationally driven and configured for cleaning at least one of a spinning rotor or a yarn draw-off nozzle of the spinning unit, said cleaning head removably attached to said extensible element so as to be replaceable with different cleaning heads; and wherein said device comprises a first said cleaning head configured for cleaning a spinning rotor of the spinning unit and having first cleaning elements disposed thereon at a location for cleaning a rotor channel of the spinning rotor, and second cleaning elements disposed thereon at a location for cleaning a rotor wall of the spinning rotor, said device further comprising a second said cleaning head configured for cleaning a yarn draw-off nozzle of the spinning unit and having cleaning elements disposed thereon with a rotational axis disposed at a non-parallel angle relative to a symmetrical axis of the yarn draw-off nozzle during a cleaning operation.

7. The cleaning device as in claim 1, wherein said cleaning head is removably attached to a drive unit, said drive unit rotating said cleaning head during a cleaning operation.

8. The cleaning device as in claim 1 wherein said cleaning head is removably attached by one of a snap-in connection or a bayonet connection.

9. The cleaning device as in claim 1, wherein said cleaning head comprises bristle elements extending radially therefrom.

10. The cleaning device as in claim 9, wherein said cleaning head is a rotor cleaning head configured for cleaning a spinning rotor of the spinning unit and comprises a first set of said bristles disposed thereon at a location for cleaning a rotor channel of the spinning rotor, and second set of said bristles disposed thereon at a location for cleaning a rotor wall of the spinning rotor.

11. A cleaning device for a rotor spinning textile machine, said device comprising:

an extensible element movable from a retracted position to an extended position towards a spinning unit of the rotor spinning machine;

at least one cleaning head configured on said extensible element so as to be adjacent the spinning unit at said extended position of said extensible element; and said cleaning head being rotationally driven and configured for cleaning at least one of a spinning rotor or a yarn draw-off nozzle of the spinning unit, said cleaning head removably attached to said extensible element so as to be replaceable with different cleaning heads; and wherein said cleaning head comprises a scraper element.

12. A cleaning device for a rotor spinning textile machine, said device comprising:

an extensible element movable from a retracted position to an extended position towards a spinning unit of the rotor spinning machine;

at least one cleaning head configured on said extensible element so as to be adjacent the spinning unit at said extended position of said extensible element; and said cleaning head being rotationally driven and configured for cleaning at least one of a spinning rotor or a yarn draw-off nozzle of the spinning unit, said cleaning head removably attached to said extensible element so as to be replaceable with different cleaning heads; and wherein said cleaning head is in communication with a compressed air source, said cleaning head comprising a nozzle disposed so as to direct compressed air therefrom against an element being cleaned by said cleaning head.

13. The cleaning device as in claim 12, wherein said cleaning head is a rotor cleaning head configured for cleaning a spinning rotor of the spinning unit, said nozzle disposed so as to direct compressed air a rotor channel of a spinning rotor.

14. The cleaning device as in claim 12, wherein said cleaning head further comprises at least one of bristles or scraping elements extending therefrom and circumferentially spaced from said nozzle such that compressed air from said nozzle is directed away from said cleaning head unimpeded by said bristles or scraping elements.

15. The cleaning device as in claim 12, further comprising a drive unit that rotationally drives said cleaning head, said compressed air source supplied to said cleaning head through a passage in said drive unit, said cleaning head removably attached to a seat in said drive unit with a locking device, said locking device automatically closing off said compressed air passage through said drive unit upon removal of said cleaning head from said seat, and automatically opening said compressed air passage upon insertion of said cleaning head into said seat.

16. The cleaning device as in claim 1, wherein said extensible element comprises a linear movement apparatus that extends and retracts an extensible arm, and a sliding groove guide, said extensible arm engaged in said sliding groove guide, said sliding groove guide having a shape so as to cause said extensible arm to also swivel as it is extended and retracted.

17. A cleaning device for a rotor spinning textile machine, said device comprising:

an extensible element movable from a retracted position to an extended position towards a spinning unit of the rotor spinning machine:

at least one cleaning head configured on said extensible element so as to be adjacent the spinning unit at said extended position of said extensible element; and said cleaning head being rotationally driven and configured for cleaning at least one of a spinning rotor or a yarn draw-off nozzle of the spinning unit, said cleaning head removably attached to said extensible element so as to be replaceable with different cleaning heads; and wherein said device comprises a first said cleaning head configured for cleaning a spinning rotor of the spinning unit, said first cleaning head rotationally driven by a first drive unit, said device further comprising a second said cleaning head configured for cleaning a yarn draw-off nozzle of the spinning unit, said second cleaning head rotationally driven by a second drive unit.

18. A cleaning device for a rotor spinning textile machine, said device comprising:

an extensible element movable from a retracted position to an extended position towards a spinning unit of the rotor spinning machine:

at least one cleaning head configured on said extensible element so as to be adjacent the spinning unit at said extended position of said extensible element; and said cleaning head being rotationally driven and configured for cleaning at least one of a spinning rotor or a yarn draw-off nozzle of the spinning unit, said cleaning head removably attached to said extensible element so as to be replaceable with different cleaning heads; and wherein said device comprises a first said cleaning head configured for cleaning a spinning rotor of the spinning unit, said device further comprising a second said cleaning head configured for cleaning a yarn draw-off nozzle of the spinning unit, said first cleaning head and said second cleaning head rotationally driven by a common drive unit.

19. A cleaning device for a rotor spinning textile machine, said device comprising:

an extensible element movable from a retracted position to an extended position towards a spinning unit of the rotor spinning machine;

at least one cleaning head configured on said extensible element so as to be adjacent the spinning unit at said extended position of said extensible element; and said cleaning head being rotationally driven and configured for cleaning at least one of a spinning rotor or a yarn draw-off nozzle of the spinning unit, said cleaning head removably attached to said extensible element so as to be replaceable with different cleaning heads; and wherein said device comprises a first said cleaning head configured for cleaning a spinning rotor of the spinning unit, said device further comprising a second said cleaning head configured for cleaning a yarn draw-off nozzle of the spinning unit, said second cleaning head connected to said extensible element so as to swivel relative to said extensible element.

* * * * *